US005467787A

United States Patent [19]

Mast et al.

[11] Patent Number: 5,467,787

[45] Date of Patent: Nov. 21, 1995

[54] SERRATED EDGE NAIL

[75] Inventors: Rolf Mast, Riverside; Dulce M. Powers, Ontario, both of Calif.

[73] Assignee: International Beauty Design, Inc., Gardena, Calif.

[21] Appl. No.: 295,418

[22] Filed: Aug. 25, 1994

[51] Int. Cl.[6] ..... A45D 29/00

[52] U.S. Cl. ..... 132/73

[58] Field of Search ..... 132/73

[56] References Cited

U.S. PATENT DOCUMENTS

| | | | |
|---|---|---|---|
| 3,487,831 | 1/1970 | Jaume et al. | 132/73 |
| 3,552,401 | 1/1971 | Michaelson et al. | 132/73 |
| 4,346,720 | 8/1982 | Hokama . | |
| 4,805,645 | 2/1989 | Schiff et al. | 132/73 |
| 5,070,892 | 12/1991 | Trematerra | 132/73 |

FOREIGN PATENT DOCUMENTS

| | | | |
|---|---|---|---|
| 2177599 | 1/1987 | United Kingdom | 132/73 |

*Primary Examiner*—John G. Weiss
*Attorney, Agent, or Firm*—William W. Haefliger

[57] ABSTRACT

An artificial fingernail, the fingernail having the form of a thin sheet extending longitudinally forwardly between proximal and distal edges; the sheet having laterally spaced edges, and having arching curvature between the lateral edges; the proximal edge characterized by a row of serrations, certain of serrations having tapering edges of different lengths, the serrations adapted to be adhesively attached to the upper surface of a natural fingernail and to be concealed therein.

14 Claims, 4 Drawing Sheets

FIG. 10.
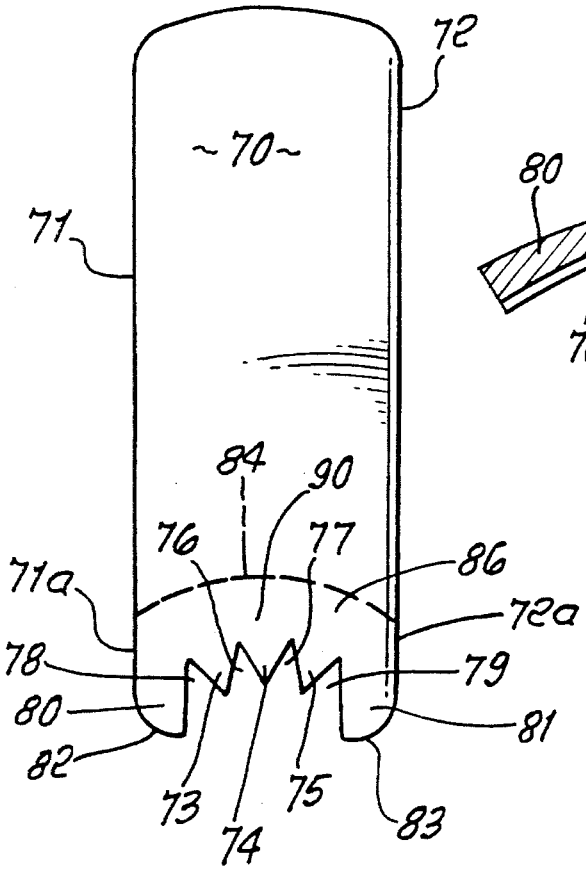
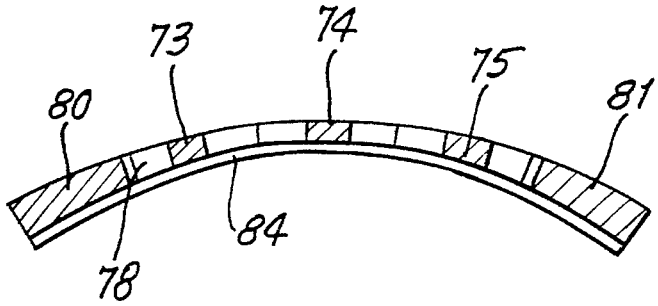
FIG. 12.
FIG. 11.
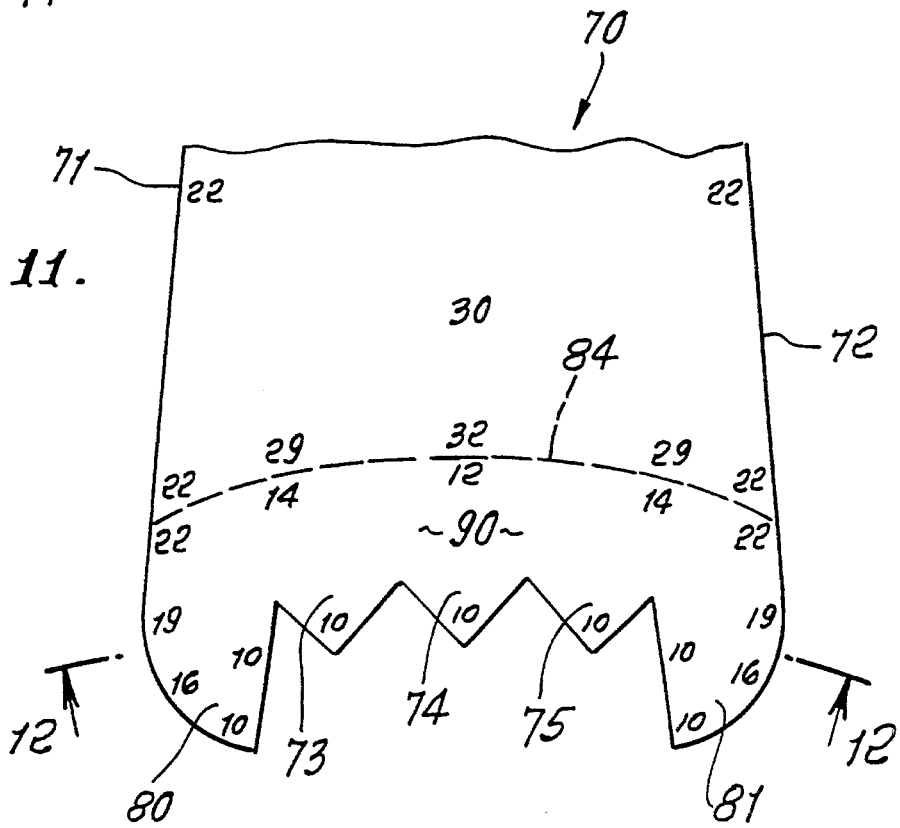

SERRATED EDGE NAIL

BACKGROUND OF THE INVENTION

This invention relates generally to the application and retention of artificial fingernails to natural fingernails; more specifically, it concerns a simple and rapid method of attaching artificial nails characterized by the elimination of prior problems and disadvantages.

The use of plastic extensions to lengthen natural fingernails is well known. In typical current usage, the plastic extension is glued to the top of the natural nail with ethylcyanoacrylate glue. Although this is a convenient way to extend the nail, this can produce an unsightly laterally extending ridge at the rearward or distal edge of the plastic extension, and which must then be removed.

There are several methods, or combinations of methods, currently utilized to remove this ridge. In one method, the ridge area is filed with fine abrasive paper. Optimally, a solvent for the nail tip may be used during filing to further speed the blending process. Although this minimizes ridge height, it is very easy to over file the natural nail without removing the ridge to visual inspection.

In a second method, a liquid overlay is brushed over the natural nail and nail tip. The overlay dries either by solvent evaporation, such as a nitrocellulose-based nail polish, or by polymerization, such as achieved by liquid/powder nail extension. This is a convenient procedure that does not physically damage the underlying nail, and greatly minimizes the contours of the ridge area. To a large extent, however, liquids conform to the underlying surface, and so, generally, reapplication and filing are needed to obtain a smooth contour.

A third method is to apply a fine, solid powder to the ridge area; and then to solidify the powder with the addition of a reactive liquid, such as ethylcyanoacrylate. Unless unusual skill is used with this method, a ridge still remains at the tip/natural nail junction. The resultant solid application is very difficult to file smoothly. Of these, although still difficult, the most common method of removing the ridge line is to use the liquid overlay/filing combination.

Another problem with the application of plastic nail extensions is that even with use of ethylcyanoacrylate glue, and a superimposed overlay, they have a tendency to be insufficiently glued and become loose. A design which would cause them to be better adhered is needed.

There is need for means and method which will alleviate the above-described problems and which will reduce or alleviate the lateral ridge formations.

There is also need for a method that will improve the adhesion of the nail tip to the natural nail.

SUMMARY OF THE INVENTION

It is a major object of the invention to provide an improved artificial fingernail characterized as overcoming the problems and difficulties referred to above. Basically, the artificial nail comprises:

a) the fingernail having the form of a thin sheet extending longitudinally forwardly between proximal and distal edges, b) the sheet having laterally spaced edges, and having arching curvature between the lateral edges, c) the proximal edge characterized by a row of specialized serrations, certain serrations having tapering edges of different lengths, the serrations adapted to be adhesively attached to the upper surface of a natural fingernail and to be concealed thereon.

It has been discovered that artificial nails provided with variable serrations, as referred to, enable ridge minimization in response to application and curing of liquid overlay solution, and/or filing techniques to lower the artificial nail surface toward the natural nail surface.

It has also been discovered that the use of serrations, as referred to herein, improves the ease and degree of adhesion when the nail tip is bonded with ethylcyanocrylate. In one embodiment of this invention, the improvement in nail tip adhesion is enhanced when there is an overlap region which has a variable thickness, thinner in the middle than on the edges.

Serrations, in accordance with the invention, can vary in number and depth (i.e., length). They may have uneven depths; and they may have rounded, as well as angled corners. Thus, the serrations need not be symmetric.

An object of the invention is to provide serrations that have rearward terminals which are in generally lateral alignment prior to and after attachment of the fingernail and the serrations to the upper surface of the natural fingernail.

Another object is to provide blunt, rearward (i.e., proximal) terminals on two of the serrations respectively closest to the laterally spaced edges of the nail.

A further object is to provide serrations with tapering edges that have certain forward terminals and other forward terminals, such certain and other forward terminals being out of generally lateral alignment. Other of the serrations located between the two blunt ended serrations have rearward terminals that define a generally laterally extending line spaced forwardly of the blunt terminals. Tapering edges of such other serrations may have forward terminals spaced forwardly of the laterally extending line.

Yet another object is to provide serrations, as referred to, wherein the certain forward terminals define a first generally laterally extending line, and the other forward terminals define a second generally laterally extending line, the first and second lines being longitudinally spaced apart.

Further objects include the provision of a sheet having a region adapted to overlap a natural nail, the sheet having reduced thickness approximately midway between its lateral edges, which are relatively thicker than the mid region, and the overlap region, including serrations. The reduced thickness zone typically extends rearwardly to at least one of the serrations. Also, the overlap region is bounded by a step shoulder at its forwardmost extent, at the underside of the sheet.

These and other objects and advantages of the invention, as well as the details of an illustrative embodiment, will be more fully understood from the following specification and drawings, in which:

DRAWING DESCRIPTION

Figure 5:
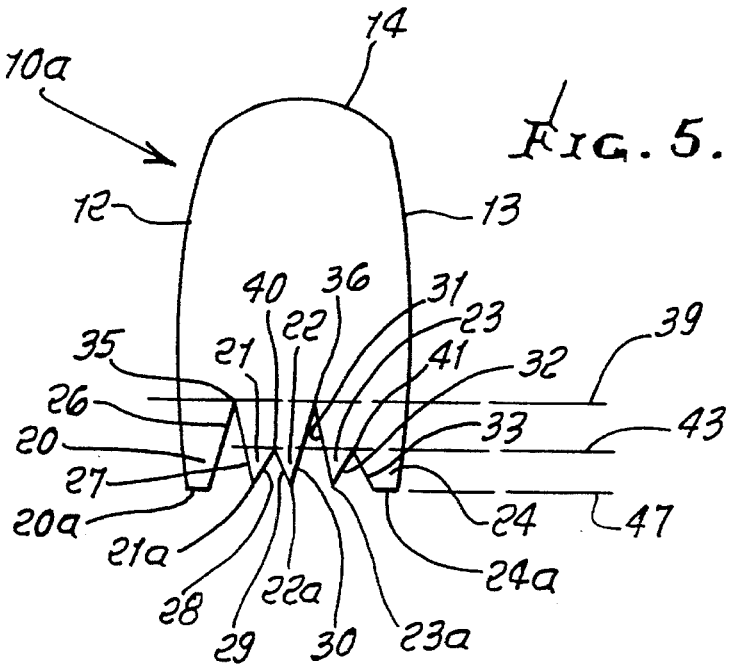
FIG. 5 is a top plan view of an artificial nail having proximal serrations of various configurations.

FIGS. 9 (*a*)–(*d*) are views like FIG. 5 showing other serration patterns;

FIG. 10 shows in plan view a serrated nail having a step shoulder;

FIG. 11 is an enlarged plan view of a serrated nail having variable thickness; and FIG. 12 is a section taken on lines 12—12 of FIG. 11.

DETAILED DESCRIPTION

Figure 1:
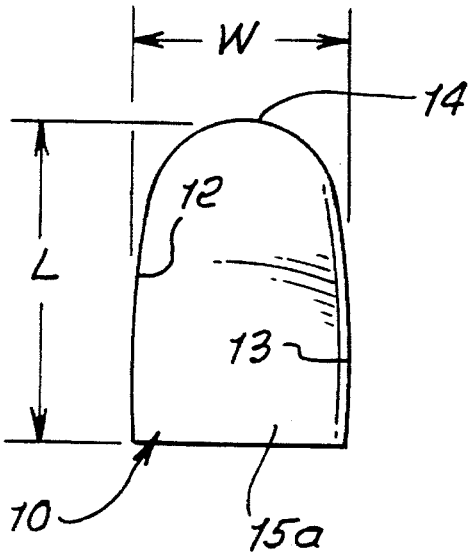
FIG. 1. (PRIOR ART)
FIG. 1 is a diagram.
Figure 2:
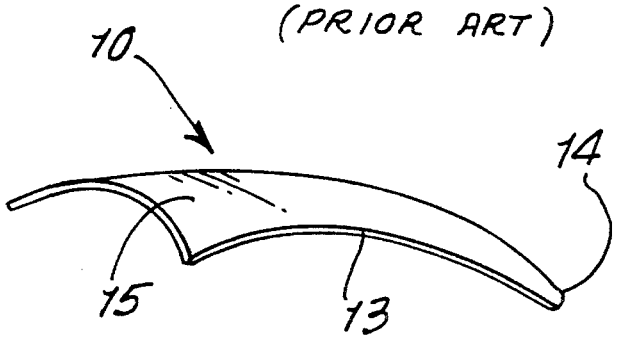
FIG. 2. (PRIOR ART)
FIG. 2 is a perspective view of an artificial nail or nail tip.

Referring first to FIG. 1, an artificial nail 10 has longitudinal overall length indicated at L, and lateral overall width W. L is generally greater than W. The nail is generally U-shaped, as defined by lateral edges 12 and 13, and forward arcuate edge 14. It is normally upwardly arched between edges 12 and 13, as indicated at arched body extent 15 in FIG. 2. Also, the nail is normally arched (to lesser extent) longitudinally, as shown.

The rearward region 15a of the nail body is intended to be serrated, in accordance with the invention, and as described herein and shown in FIGS. 5–7 and 9.

Typically, the nails or nail tips are injection molded, and consist of synthetic plastic material, such as cellulose acetate, acrylonitrile copolymer, butadiene copolymer, styrene copolymer, or Nylon.

Figure 3:
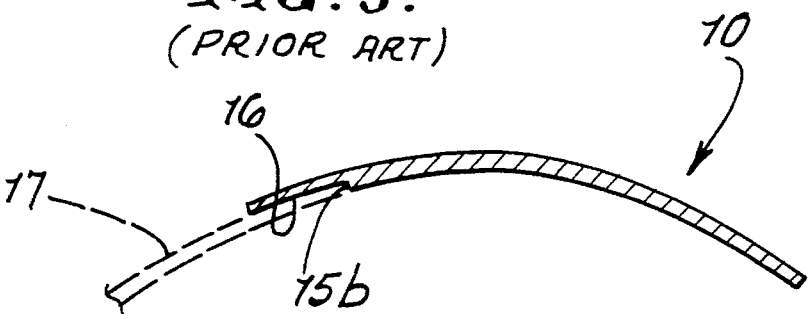
FIG. 3. (PRIOR ART)
FIG. 3 is a longitudinal cross section through an artificial nail having a recess to receive the top of a natural nail.

FIG. 3 shows the nail 10 in the form of a nail tip having a rearward peripheral distal edge 15*b* and forming a recess 16 to receive the forward edge portion of a natural nail (see broken lines 17 in FIG. 3), to be bonded to the surface of 10 forming the recess 16.

Figure 4:
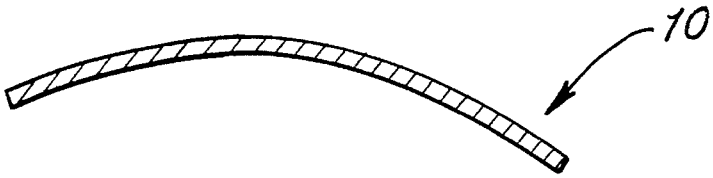
FIG. 4. (PRIOR ART)
FIG. 4 is like FIG. 3 but without provision of a recess.

FIG. 4 shows the nail 10 without such a recess. See also U.S. Pat. No. 4,346,720 describing such a recess. The overall thickness of the nail tip is between 0.015 and 0.045 inches.

The artificial nail, in accordance with the invention, comprises:

a) a thin, plastic sheet extending longitudinally forwardly between proximal and distal edges, b) the sheet having laterally spaced edges, and having arching curvature between the lateral edges, c) the proximal edge characterized by a row of serrations, certain of serrations having tapering edges of different lengths, the serrations adapted to be adhesively attached to the upper surface of a natural fingernail and to be concealed therein.

It is found that such variable serrations, having tapering edges of different lengths, become adhesively bonded very firmly to the top of the natural nail. Filing of the serrations by the user does not disrupt the firm bond.

FIG. 5 shows one form of the artificial nail in modified form 10*a* with differential serrations 20–24. For example, serrations 20 and 24 closest to edges 12 and 13 are not necessarily alike, yet have blunt, rearward edge terminals at 20*a* and 24*a*, so as not to dangerously penetrate natural nail cuticle. The serrations 20–24 have rearward terminals 20*a*–24*a* which are in lateral alignment, in plan view shown, prior to and after attachment, as by bonding of the serrations to the upper surface of the natural nail, using ethylcyanoacrylate glue.

The serrations have tapering edges 26–33, generally of differential length and angularity, although some of such lengths and angularities may be equal. Edges 26 and 27 define a forward apex terminal 35; edges 30 and 31 define a forward apex terminal 36; and terminals 35 and 36 define a first lateral line 39. Edges 28 and 29 define a forward apex terminal 40; edges 32 and 33 define a forward apex terminal 41; and terminals 40 and 41 define a second lateral line 43. Edges 27 and 28 define a rearward apex terminal 21*a*; edges 29 and 30 define a rearward apex 22*a*; and edges 31 and 32 define a rearward apex terminal 23*a*. Terminals 21*a*, 22*a* and 23*a* define a third lateral line 47. Line 43 lies between and is spaced from lines 39 and 47.

Figure 6:
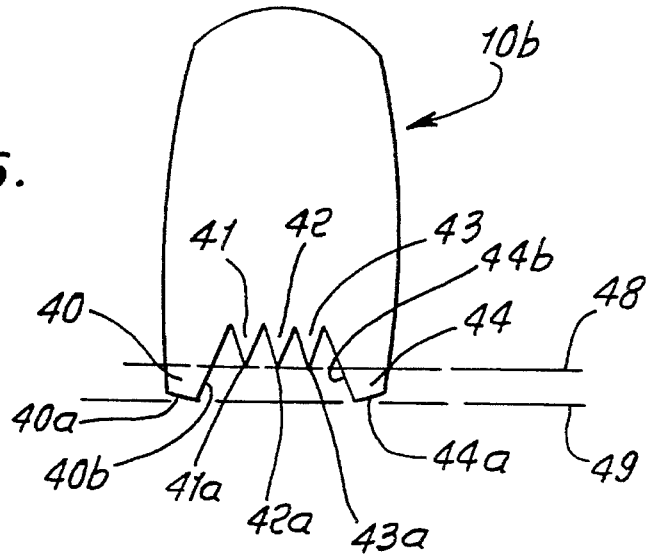
FIG. 6 is a view like FIG. 5 but showing another pattern of serrations.

In FIG. 6, 40*a* and 44*a* correspond to 20*a* and 24*a* in FIG. 5; and serrations 40 and 44 correspond to 20 and 24. Intermediate serrations 41–43 are alike, and shorter than 40 and 44. Rearward sharp terminals 41*a*–43*a* of 41 to 43 define a lateral line 48, which is spaced forwardly of and parallel to lateral line 49 defined by 40*a* and 44*a*. The nail itself is designated at 10*b*. Serration edges 40*b* and 44*b* are longer than the edges of serrations 41–43.

Figure 7:
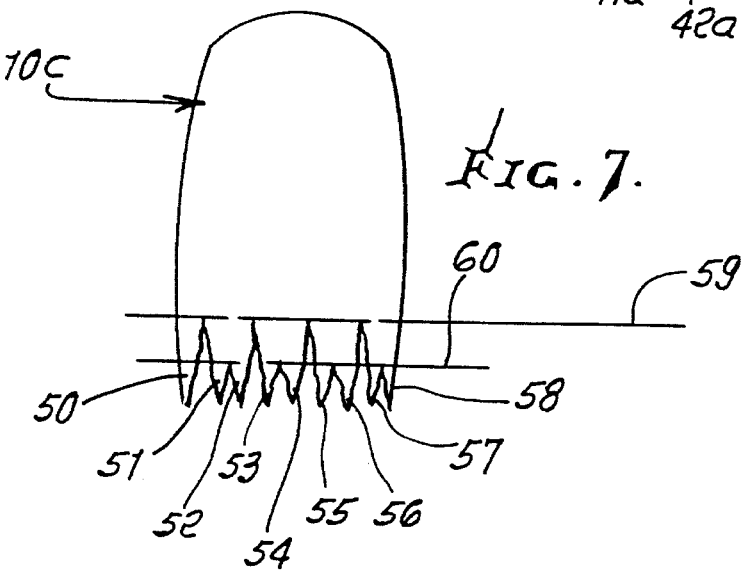
FIG. 7 is a view like FIG. 5 but showing a further pattern of serrations.

In FIG. 7, nail 10*c* has rearward serrations 50–58 are again variable in that two lateral lines 59 and 60 are determined by serration tips, as shown. The opposite edges of each of the serrations 51–57 are of different lengths, as shown.

Figure 8:
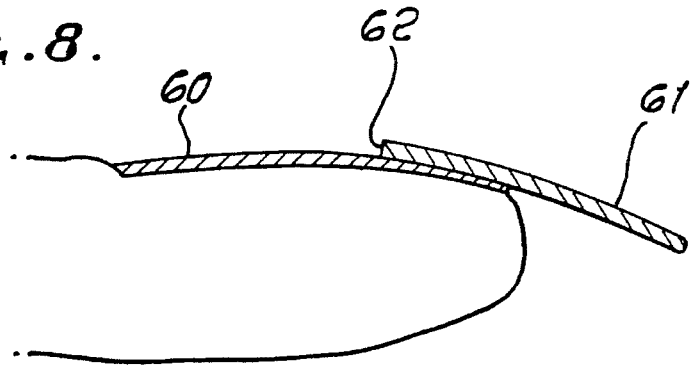
FIG. 8 is a section showing an artificial nail applied to a natural nail and having a ridge.
Figure 9A:
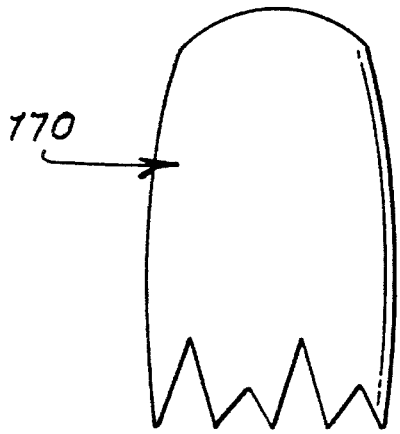
Figure 9B:
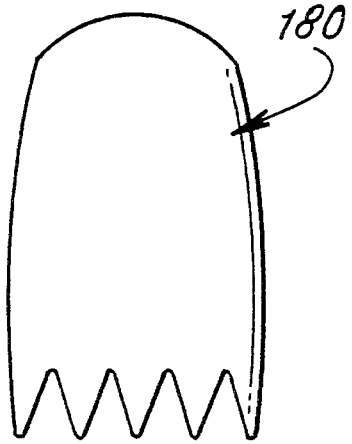
Figure 9C:
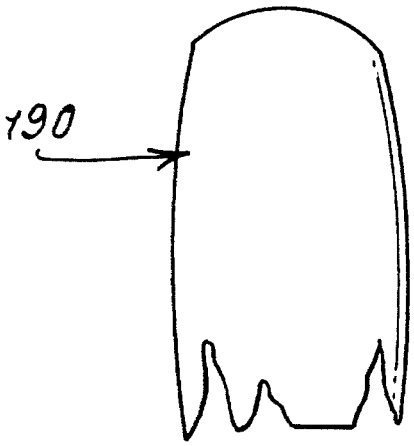
Figure 9D:
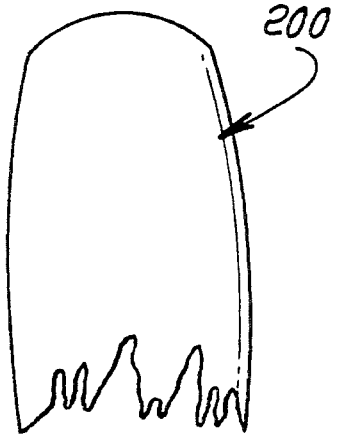

FIG. 8 shows adhesive bonding of one of the nails of FIGS. 5–7 to a natural nail 60. The artificial nail is designated at 61 and has a ridge 62 defined by rearwardmost tapered tips. Thus, the ridge is easy to file down toward the level of the natural nail.

FIGS. 9 (*a*)–9 (*d*) show artificial nails 170, 180, 190, and 200 having other variable serration patterns.

FIG. 10 shows a serrated artificial nail 70 having elongated lateral edges 71 at 72, and serrations 73–75 that taper rearwardly, and gaps 76 and 77 between the serrations. See also gaps 78 and 79 between serrations 73 and 75, and the laterally spaced edge portions 80 and 81 of the nail. Those portions have rearward edges that are convexly arcuate at 82 and 83. A transverse step shoulder 84 is formed at the underside of the nail and is rearwardly concave to abut the forward convex edge of a natural nail, to define an overlap region 86 of the nail 70 that overlaps and adhesively bonds to the top surface of the natural nail.

Serrations 73–75 are rearward of shoulder 84. The lateral edges 71*a* and 72*a* of the overlap regions typically are thicker than the upwardly arched mid region 90 of the overlap region, so as not to cut into finger flesh during adherence.

FIG. 11 is an enlarged view of a nail 70 like that of FIG. 10, with thickness indicating numerals (thousandths of an inch) placed on the nail. Note that the nail, at the step shoulder, decreases in thickness from 0.022 to about 0.012, at the mid portion.

FIG. 12 is a cross section taken on lines 12—12 of FIG. 11, and showing reduced thickness of the top serration 74 midway between thicker edge portions 80 and 81. Serrations 73 and 74 bear similar reduced thickness, as shown.

The following ranges of thicknesses are preferred:

| Preferred Range | Maximum Range |
|---|---|
| Edge Thickness* of Overlap Region | |
| 0.025–0.018 | 0.035–0.012 |
| Central Thickness* of Overlap Region | |
| 0.015–0.009 | 0.025–0.0006 |

-continued

| Preferred Range | Maximum Range |
|---|---|

*Measurements are in inches.

It is found that when the nail tip is initially adhered to that natural nail using ethylcyanoacrylate glue, the serrations allow a better adhesive bond to be formed strengthening the initial fit of the tip to the natural nail. This is a very big advantage also, because it helps stop the extension from coming loose through wear. It also prevents the formation of air pockets under the tip making a more hygienic extension.

Some of the improvements in initial adhesion comes from a combination of the serrated edge and the decreased thickness in the central overlap section of the nail.

By having the edges of the overlap region thicker than the central part of the overlap region, there is less of a step in height at the edge of the nail in moving from the overlap to the free foward extension. In other words, there is more of a step in the center of the nail when going longitudinally from the overlap area to the free forward extension, than there is at the side of the nail when going longitudinally from the overlap area to the free forward extension. Observations have shown that this in turn causes the subsequently applied overall to be more even along the edge of the nail. This is a considerable advantage in that snagging of clothing, etc., by an uneven edge is greatly minimized.

We claim:

1. An artificial fingernail comprising:

a) said fingernail having the form of a thin sheet extending longitudinally forwardly between proximal and distal edges, b) said sheet having laterally spaced edges, and having arching curvature between said lateral edges, c) said proximal edge characterized by a row of serrations, certain of serrations having tapering edges of different lengths, said serrations adapted to be adhesively attached to the upper surface of a natural fingernail and to be concealed thereon, d) two of said serrations respectively closest to said laterally spaced edges of the sheet having rearwardly presented terminals that are sufficiently blunt so as not to dangerously penetrate natural nail cuticle.

2. The artificial fingernail of claim 1 wherein said serrations have rearward terminals which are in generally lateral alignment prior to and after attachment of the fingernail including serrations to said upper surface of the natural fingernail.

3. The artificial fingernail of claim 1 wherein said serration tapering edges have certain forward terminals and other forward terminals, said certain and other forward terminals being out of generally lateral alignment.

4. The artificial fingernail of claim 3 wherein said certain forward terminals define a first generally laterally extending line, and said other forward terminals define a second generally laterally extending line, said first and second lines being longitudinally spaced apart.

5. The artificial fingernail of claim 2 wherein said serration tapering edges have certain forward terminals and other forward terminals, said certain and other forward terminals being out of generally lateral alignment.

6. The artificial fingernail of claim 1 wherein said serrations are alike.

7. The artificial fingernail of claim 1 wherein the sheet has a region adapted to overlap a natural nail, said serrations located at said region.

8. The artificial fingernail of claim 7 wherein said sheet, at said overlap region, has reduced thickness approximately midway between said lateral edges.

9. The artificial fingernail of claim 7 wherein said sheet defines a step shoulder at the forwardmost extent of said overlap region, said sheet having an underside at which said shoulder is located.

10. The combination of claim 8 wherein said reduced thickness of said overlap region extends to at least one of said serrations.

11. The combination of claim 7 wherein said sheet lateral edges, at said overlap region, have greater thickness than said sheet midway between said lateral edges.

12. An artificial fingernail comprising:

said fingernail having the form of a thin sheet extending longitudinally forwardly between proximal and distal edges, b) said sheet having laterally spaced edges, and having arching curvature between said lateral edges, c) said proximal edge characterized by a row of serrations, certain of serrations having tapering edges of different lengths, said serrations adapted to be adhesively attached to the upper surface of a natural fingernail and to be concealed thereon, d) and wherein two of said serrations respectively closest to said laterally spaced edges of the sheet have blunt proximal terminals.

13. The artificial fingernail of claim 12 wherein others of said serrations located generally laterally between said two serrations have rearward terminals that define a generally laterally extending line spaced forwardly of said blunt terminals.

14. The artificial fingernail of claim 13 wherein said tapering edges of said other serrations have forward terminals spaced forwardly of said laterally extending line.

* * * * *